US007587936B2

(12) United States Patent
Han

(10) Patent No.: US 7,587,936 B2
(45) Date of Patent: Sep. 15, 2009

(54) APPARATUS AND METHOD FOR DETERMINING DRILLING FLUID ACOUSTIC PROPERTIES

(75) Inventor: Wei Han, Sugar Land, TX (US)

(73) Assignee: Smith International Inc., Houston, TX (US)

( * ) Notice: Subject to any disclaimer, the term of this patent is extended or adjusted under 35 U.S.C. 154(b) by 171 days.

(21) Appl. No.: 11/701,260

(22) Filed: Feb. 1, 2007

(65) Prior Publication Data

US 2008/0186805 A1 Aug. 7, 2008

(51) Int. Cl.
*E21B 47/00* (2006.01)
*G11H 5/00* (2006.01)
*G01V 1/00* (2006.01)

(52) U.S. Cl. ..... 73/152.43; 73/597; 367/25

(58) Field of Classification Search ..... 73/152.03, 73/152.15, 152.47, 152.01, 152.18, 152.43, 73/975; 702/6; 367/28, 25; 181/102
See application file for complete search history.

(56) References Cited

U.S. PATENT DOCUMENTS

| | | | |
|---|---|---|---|
| 3,381,267 | A | 4/1968 | Cubberly, Jr., et al. |
| 3,493,921 | A | 2/1970 | Johns |
| 3,553,640 | A | 1/1971 | Zemanek |
| 3,663,842 | A | 5/1972 | Miller |
| 3,770,006 | A | 11/1973 | Sexton et al. |
| 3,792,429 | A | 2/1974 | Patton et al. |
| 3,867,714 | A | 2/1975 | Patton |
| 4,382,201 | A | 5/1983 | Trzaskos |
| 4,450,540 | A | 5/1984 | Mallett |
| 4,485,321 | A | 11/1984 | Klicker et al. |
| 4,523,122 | A | 6/1985 | Tone et al. |
| 4,543,648 | A | 9/1985 | Hsu |
| 4,571,693 | A | 2/1986 | Birchak et al. |
| 4,594,691 | A | 6/1986 | Kimball et al. |
| 4,628,223 | A | 12/1986 | Takeuchi et al. |
| 4,649,526 | A | 3/1987 | Winbow et al. |

(Continued)

FOREIGN PATENT DOCUMENTS

| | | |
|---|---|---|
| CA | 2346546 | 11/2001 |

(Continued)

OTHER PUBLICATIONS

Boonen, P. and Yogeswaren, E., "A dual frequency LWD sonic tool expands exhibiting unipolar transmitter technology to supply shear wave data in soft formations," SPWLA 45th Annual Logging Symposium, Jun. 6-9, 2004, Noordwijk, Netherlands, Paper X.

(Continued)

*Primary Examiner*—John Fitzgerald

(57) ABSTRACT

Aspects of this invention include a downhole tool having first and second radially offset ultrasonic standoff sensors and a controller including instructions to determine at least one of a drilling fluid acoustic velocity and a drilling fluid attenuation coefficient from the reflected waveforms received at the standoff sensors. The drilling fluid acoustic velocity may be determined via processing the time delay between arrivals of a predetermined wellbore reflection component at the first and second sensors. The drilling fluid attenuation coefficient may be determined via processing amplitudes of the predetermined wellbore reflection coefficients. The invention advantageously enables the acoustic velocity and attenuation coefficient of drilling fluid in the borehole annulus to be determined in substantially real-time.

21 Claims, 5 Drawing Sheets

U.S. PATENT DOCUMENTS 4,665,511 A 5/1987 Rodney et al.
4,682,308 A 7/1987 Chung
4,686,409 A 8/1987 Kaarmann et al.
4,698,792 A 10/1987 Kurkjian et al.
4,698,793 A 10/1987 Wu
4,700,803 A 10/1987 Mallett et al.
4,705,981 A 11/1987 Inoue et al.
4,774,693 A 9/1988 Winbow et al.
4,800,316 A 1/1989 Ju-Zhen
4,832,148 A 5/1989 Becker et al.
4,855,963 A 8/1989 Winbow et al.
4,872,526 A 10/1989 Wignall et al.
4,890,268 A 12/1989 Smith et al.
5,027,331 A 6/1991 Winbow et al.
5,036,945 A 8/1991 Hoyle et al.
5,038,067 A 8/1991 Tabin
5,038,069 A 8/1991 Lukasiewicz et al.
5,044,462 A * 9/1991 Maki, Jr. ..... 181/103
5,077,697 A 12/1991 Chang
5,109,698 A 5/1992 Owen
5,130,950 A 7/1992 Orban et al.
5,191,796 A 3/1993 Kishi et al.
5,214,251 A * 5/1993 Orban et al. ..... 181/102
5,229,553 A 7/1993 Lester et al.
5,265,067 A 11/1993 Chang
5,278,805 A 1/1994 Kimball
5,331,604 A 7/1994 Chang et al.
5,341,345 A * 8/1994 Warner et al. ..... 367/99
5,387,767 A 2/1995 Aron et al.
RE34,975 E 6/1995 Orban et al.
5,469,736 A 11/1995 Moake
5,486,695 A 1/1996 Schultz et al.
5,510,582 A 4/1996 Birchak et al.
5,513,528 A * 5/1996 Holenka et al. ..... 73/152.03
5,544,127 A 8/1996 Winkler
5,644,186 A 7/1997 Birchak et al.
5,661,696 A 8/1997 Kimball et al.
5,678,643 A 10/1997 Robbins et al.
5,711,058 A 1/1998 Frey
5,726,951 A 3/1998 Birchak et al.
5,753,812 A 5/1998 Aron et al.
5,784,333 A 7/1998 Tang et al.
5,808,963 A 9/1998 Esmersoy
5,831,934 A 11/1998 Gill et al.
5,844,349 A 12/1998 Oakley et al.
5,852,587 A 12/1998 Kostek et al.
5,899,958 A 5/1999 Dowell et al.
5,936,913 A 8/1999 Gill et al.
5,960,371 A 9/1999 Saito et al.
6,014,898 A 1/2000 Finsterwald et al.
6,067,275 A 5/2000 Sayers
6,082,484 A 7/2000 Molz et al.
6,088,294 A 7/2000 Leggett, III et al.
6,102,152 A 8/2000 Masino et al.
6,107,722 A 8/2000 Thurn
6,147,932 A 11/2000 Drumheller
6,188,647 B1 2/2001 Drumheller
6,208,585 B1 3/2001 Stroud
6,213,250 B1 4/2001 Wisniewski et al.
6,236,144 B1 5/2001 Millar et al.
6,258,034 B1 7/2001 Hanafy
6,272,916 B1 8/2001 Taniguchi et al.
6,308,137 B1 10/2001 Underhill et al.
6,310,426 B1 10/2001 Birchak et al.
6,320,820 B1 11/2001 Gardner et al.
6,354,146 B1 3/2002 Birchak et al.
6,396,199 B1 5/2002 Douglas et al.
6,405,136 B1 6/2002 Li et al.
6,459,993 B1 10/2002 Valero et al.
6,467,140 B2 10/2002 Gururaja
6,477,112 B1 11/2002 Tang et al.
6,480,118 B1 11/2002 Rao
6,535,458 B2 3/2003 Meehan
6,543,281 B2 4/2003 Pelletier et al.
6,568,486 B1 5/2003 George
6,607,491 B2 8/2003 Sato
6,614,716 B2 9/2003 Plona et al.
6,615,949 B1 9/2003 Egerev et al.
6,618,322 B1 9/2003 Georgi
6,625,541 B1 9/2003 Shenoy et al.
6,631,327 B2 10/2003 Hsu et al.
6,654,688 B1 11/2003 Brie et al.
6,671,380 B2 12/2003 Chang et al.
6,672,163 B2 * 1/2004 Han et al. ..... 73/597
6,776,762 B2 8/2004 Erikson et al.
6,788,620 B2 9/2004 Shiraishi et al.
6,817,229 B2 * 11/2004 Han et al. ..... 73/64.53
6,829,947 B2 * 12/2004 Han et al. ..... 73/861.19
6,894,425 B1 5/2005 Solomon et al.
6,897,601 B2 5/2005 Birth et al.
6,938,458 B2 * 9/2005 Han et al. ..... 73/19.09
6,995,500 B2 * 2/2006 Yogeswaren ..... 310/334
7,036,363 B2 * 5/2006 Yogeswaren ..... 73/152.16
7,129,477 B2 * 10/2006 Schneider et al. ..... 250/266
7,367,392 B2 * 5/2008 Duong et al. ..... 166/249
7,418,865 B2 * 9/2008 Griffiths et al. ..... 73/597
2002/0062992 A1 5/2002 Fredericks et al.
2002/0096363 A1 7/2002 Evans et al.
2002/0113717 A1 8/2002 Tang et al.
2003/0002388 A1 1/2003 Mandal
2003/0018433 A1 1/2003 Blanch et al.
2003/0058739 A1 3/2003 Hsu et al.
2003/0106739 A1 6/2003 Arian et al.
2003/0114987 A1 6/2003 Edwards et al.
2003/0123326 A1 7/2003 Wisniewski et al.
2003/0137302 A1 7/2003 Clark et al.
2003/0137429 A1 7/2003 Clark et al.
2003/0139884 A1 7/2003 Blanch et al.
2003/0141872 A1 7/2003 Clark et al.
2003/0150262 A1 8/2003 Han et al.
2003/0167126 A1 9/2003 Horne et al.
2004/0095847 A1 * 5/2004 Hassan et al. ..... 367/25
2005/0006620 A1 1/2005 Helke
2005/0150655 A1 * 7/2005 Duong et al. ..... 166/249
2005/0259512 A1 * 11/2005 Mandal ..... 367/10
2006/0285439 A1 * 12/2006 Haugland ..... 367/75

FOREIGN PATENT DOCUMENTS

EP 0375549 A2 6/1990
EP 1158138 A2 11/2001
GB 62156984 A 10/1985
GB 2381847 A 5/2003
WO WO0072000 A1 11/2000

OTHER PUBLICATIONS

Cheng, C. H. and Toksoz, M. N., "Elastic Wave Propagation in a Fluid-Filled Borehole and Synthetic Acoustic Logs," Geophysics, vol. 46, No. 7, Jul. 1981, pp. 1042-1053.

Cheng, C. H. and Toksoz, M. N., "Determination Of Shear Wave Velocities In "Slow" Formations," SPWLA 24th Annual Logging Symposium, Jun. 37-30, 1983, Paper V.

El-Wazeer, F. et al., "Applications For A Full Wave Sonic LWD Tool in the Middle East," Society of Petroleum Engineers 13th Middle East Oil Show & Conference, Apr. 5-8, 2003, SPE 81474.

Gardner, G. H. F., et al., "Formation Velocity and Density—The Diagnostic Basics for Stratigraphic Traps," Geographics, vol. 39, No. 6, Dec. 1974, pp. 770-780.

Haugland, S. M., "Analytical Solution for an Eccentric Mandrel in a Fluid-filled Borehole: The Acoustic Case," SEG International Exhibition and 74th Annual Meeting, Denver, CO, Oct. 10-15, 2004.

Haugland, S. M., "Frequency Dispersion Effects on LWD Shear Sonic Measurements in Acoustically Sloe Environments," SPE Paper 90505, SPE Annual Technical Conference and Exhibition, Houston, Texas, Sep. 26-29, 2004.

Haugland, S. M., "Mandrel Eccentricity Effects on Acoustic Borehole-Guided Waves," SEG International Exhibition and 74th Annual Meeting, Denver, Co, Oct. 10-15, 2004.

Haung, X., "Effects of Tool Positions on Borehole Acoustic Measurements: A Stretched Grid Finite Difference Approach," Dissertation, MIT, Apr. 2003.

Hsu, C. and Sinha,K.K., "Mandrel effects on the dipole flexural mode in a borehole," J. Acoust. Soc. Am. 104(4), Oct. 1998, pp. 2025-2039.

Market, J., et al., "Processing and Quality Control of LWD Dipole Sonic Measurements," SPWLA 43rd Annual Logging Symposium, Jun. 2-5, 2002, Paper PP.

Schmitt, D. P., "Shear Wave Logging in Elastic Formations," J. Acoust. Soc. A., 84(6), Dec. 1988, pp. 2215-2229.

Smith, W.A., "New Opportunities in Ultrasonic Transducers Emerging from Innovations in Piezoelectric Materials", SPIE vol. 1733, 1992, pp. 3-26.

Taner, M.T., Koehler, F., and Sheriff, R. E., "Complex seismic trace analysis," Geophysics, vol. 44, No. 6 (Jun. 199); pp. 1041-1063.

Tang, X.M., et al., "Shear-Velocity Measurements in the Logging-While Drilling Environment: Modeling and Field Evaluations," Petrophysics, vol. 44, No. 2 (Mar.-Apr. 2003), pp. 79-90.

Varsamis, G. L., et al, "LWD Shear Velocity Logging in Slow-Formations Design Decisions and Case Histories," SPWLA 41st Annual Logging Symposium, Jun. 4-7, 2000, Paper O.

Varsamis, G.L., et al., "A New MWD Full Wave Dual Mode Sonic Tool Design And Case Histories," SPWLA 40th Annual Logging Symposium, May 30-Jun. 3, 1999, Paper P.

Winbow, G.A., "A theoretical study of acoustic-S-wave and P-wave velocity logging with conventional and dipole sources in soft formations," *Geophysics*, vol. 53, No. 10, Oct. 1988, pp. 1334-1342.

Product Literature "Dyneon Fluoroelastomer FC2178", obtained from Dyneon, Decator, Alabama, Jun. 2003.

Product Literature "Dyneon Fluoroelastomer FC2181", obtained from Dyneon, Decator, Alabama, Jun. 2003.

Product Literature "Dyneon Fluoroelastomer FE5623", obtained from Dyneon, Decator, Alabama, Jun. 2003.

Product Literature Obtained from Ohara Corporation, 23141 Arroyo Vista, Santa Margarita, CA, Jul. 2003. http://www.oharacorp.com/swf/ap.html.

Technical Information "Viton®B-50", DuPont Dow elastomers, dated Dec. 1998, Wilmington, Delware 19809.

* cited by examiner

APPARATUS AND METHOD FOR DETERMINING DRILLING FLUID ACOUSTIC PROPERTIES

FIELD OF THE INVENTION

The present invention relates generally to a downhole method of determining standoff and drilling fluid acoustic properties. More particularly, this invention relates to an apparatus and method for the downhole determination of acoustic velocity and attenuation coefficient of drilling fluid using first and second radially offset ultrasonic transducers.

BACKGROUND OF THE INVENTION

Logging while drilling (LWD) techniques are well-known in the downhole drilling industry and are commonly used to measure borehole and formation properties during drilling. Such LWD techniques include, for example, natural gamma ray, spectral density, neutron density, inductive and galvanic resistivity, acoustic velocity, acoustic caliper, downhole pressure, and the like. Many such LWD techniques require that the standoff distance between the logging sensors in the borehole wall be known with a reasonable degree of accuracy. For example, LWD nuclear/neutron techniques utilize the standoff distance in the count rate weighting to correct formation density and porosity data.

Measurement of the standoff distance is also well-known in the art. Conventionally, standoff measurements typically include transmitting an ultrasonic pulse into the drilling fluid and receiving the portion of the ultrasonic energy that is reflected back to the receiver from the drilling fluid borehole wall interface. The standoff distance is then typically determined from the acoustic velocity of the drilling fluid and the time delay between transmission and reception of the ultrasonic energy.

One drawback with such conventional standoff measurements is that the acoustic velocity of the drilling fluid can vary widely depending on the borehole conditions. For example, the presence of cuttings, hydrocarbons (either liquid or gas phase), and/or water in the drilling fluid is known to have a significant effect on both the acoustic velocity and the attenuation coefficient of the drilling fluid. Moreover both temperature and pressure are also known to have an effect on the acoustic velocity and attenuation coefficient of the drilling fluid. Typically only temperature and pressure changes are accounted in estimates of the acoustic velocity. In the current state-of-the-art, the acoustic velocity of the drilling fluid is estimated based on type of mud, salinity, downhole temperature and pressure measurements, and empirically derived equations (or lookup tables) that are based on laboratory measurements of the base drilling fluid. The presence or absence of cuttings, oil, water, and/or gas bubbles in the drilling fluid typically go unaccounted. Depending on the type of drilling fluid and on the concentration of cuttings, oil, water, and/or gas bubbles therein, the degree of error to the estimated acoustic velocity and attenuation coefficient can be significant. Moreover, as indicated above, such errors are not isolated, but can result in standoff distance errors, which can lead to subsequent LWD nuclear data weighting errors. Acoustic velocity errors can also have a direct affect on sonic LWD data quality. For example, in acoustically slow formations (where the formation shear velocity is less than the drilling fluid velocity), the borehole guided or flexural wave is present in the waveform. To determine the true formation shear velocity, the computed guided/flexural velocity typically needs to be corrected using a dispersion correction model. Errors in the acoustic velocity of the drilling fluid used in the model can therefore result in errors in formation shear velocity estimates.

Therefore, there exists a need for an apparatus and method for making real-time, in-situ (i.e., downhole) measurements of the acoustic velocity of the drilling fluid. Such measurements would potentially improve the reliability of downhole standoff/caliper measurements and nuclear and sonic LWD data. An apparatus and method for making real-time, in-situ measurements of the attenuation co-efficient of the drilling fluid would also be advantageous.

SUMMARY OF THE INVENTION

The present invention addresses one or more of the above-described drawbacks of prior art standoff measurement techniques and prior art drilling fluid acoustic velocity estimation techniques. One aspect of this invention includes a downhole tool having first and second radially offset ultrasonic standoff sensors. The ultrasonic sensors are preferably closely spaced axially and deployed at the same azimuth (tool face); although as described in more detail below the invention is not limited in these regards. In one exemplary embodiment, the standoff sensors are configured to make substantially simultaneous (e.g., within about 10 ms firing repetition) standoff measurements. The ultrasonic waveforms received at each of the transducers (ultrasonic sensors) may be processed to determine arrival times and amplitudes of one or more predetermined wellbore reflection components. The drilling fluid acoustic velocity may be determined from the difference between the arrival times (i.e., the time delay between the predetermined wellbore reflection components received at the first and second sensors). The drilling fluid acoustic attenuation coefficient may be determined from the ratio of the amplitudes at each of the first and second standoff sensors.

Exemplary embodiments of the present invention advantageously provide several technical advantages. For example, the apparatus and method of this invention enable the acoustic velocity and attenuation coefficient of drilling fluid in the borehole annulus to be determined in substantially real-time. Such real-time measurements provide for improved accuracy over prior art estimation techniques, which may improve the accuracy of standoff measurements and certain LWD data. As determined by exemplary embodiments of this invention, the drilling fluid acoustic properties are typically substantially independent of tool azimuth and eccentricity. The determined drilling fluid acoustic properties are also advantageously largely unaffected by the acoustic impedance of the drilling fluid and the acoustic impedance of the borehole itself.

Those of ordinary skill in the art will also recognize that in-situ monitoring of the variation in fluid velocity and attenuation coefficient tends to advantageously provide useful information for down-hole fluid and formation property characterization and for drilling process monitoring and diagnosis in real time.

Moreover, downhole tools in accordance with this invention may advantageously provide for more accurate standoff measurements. The radially offset sensors tend to provide for better sensitivity and resolution, as well as additional flexibility in transducer configuration and selection for both small and large standoffs. For example, one transducer may be configured to be more sensitive to small standoff values while the other may be better suited for large standoff detection. In certain applications, the two sensors may also be advantageously operated in different modes (e.g., pitch-catch or pulse-echo), be of different sizes, operate at different ultrasonic frequencies, and/or configured to have different focal depths.

In one aspect the present invention includes a downhole measurement tool. The measurement tool includes a substantially cylindrical tool body having a cylindrical axis and first and second radially offset standoff sensors deployed on the tool body. Each of the standoff sensors are configured to (i) transmit an ultrasonic pressure pulse into a borehole and (ii) receive a reflected waveform. The measurement tool also includes a controller including instructions for determining at least one of (i) a drilling fluid acoustic velocity and (ii) a drilling fluid attenuation coefficient from the reflected waveforms received at the first and second standoff sensors.

In another aspect, this invention includes a method for determining an acoustic velocity of drilling fluid in a borehole. The method includes transmitting first and second acoustic signals in a borehole utilizing corresponding first and second radially offset transducers and receiving first and second reflected signals at the corresponding first and second transducers from the corresponding first and second transmitted acoustic signals. The method further includes determining a time delay between a predetermined wellbore reflection component of the corresponding first and second reflected signals and processing the time delay to determine the acoustic velocity of the drilling fluid.

In still another aspect, this invention includes a method for determining an attenuation coefficient of drilling fluid in a borehole. The method includes transmitting first and second acoustic signals in a borehole utilizing corresponding first and second radially offset transducers and receiving first and second reflected signals at the corresponding first and second transducers from the corresponding first and second acoustic signals. The method also includes determining an amplitude of a first predetermined component of each of the corresponding first and second reflected signals and processing the amplitudes to determine the attenuation coefficient of the drilling fluid.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
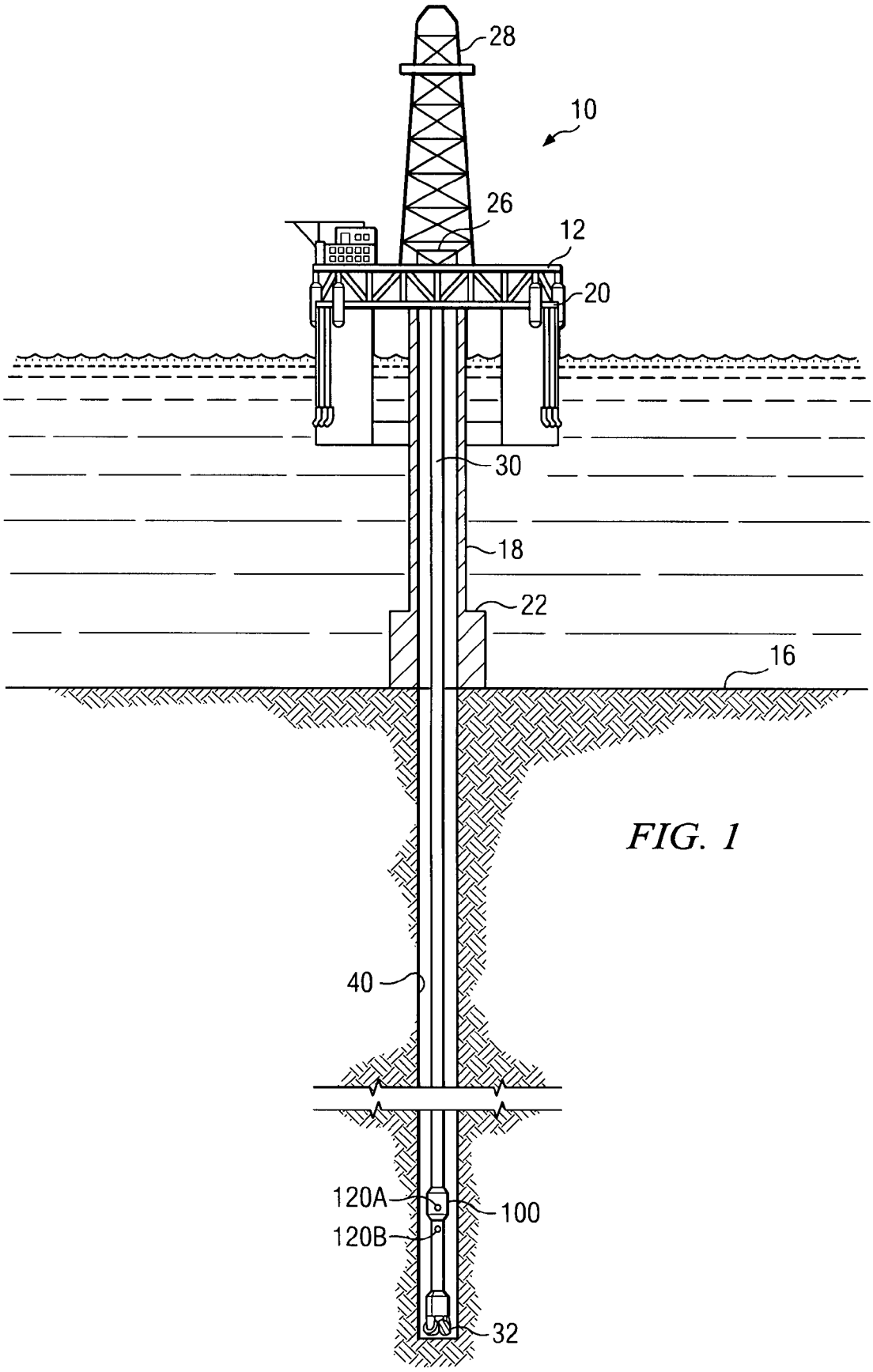
FIG. 1 is a schematic representation of an offshore oil and/or gas drilling platform utilizing an exemplary embodiment of the present invention.

FIG. 1 depicts one exemplary embodiment of a measurement tool 100 according to this invention in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a downhole measurement tool 100 having first and second radially and axially offset ultrasonic standoff sensors 120A and 120B. Drill string 30 may further include substantially any other downhole tools, including for example, a downhole drill motor, a mud pulse telemetry system, and one or more other sensors, such as a nuclear or sonic logging while drilling tool, for sensing downhole characteristics of the borehole and the surrounding formation.

It will be understood by those of ordinary skill in the art that the measurement tool 100 of the present invention is not limited to use with a semisubmersible platform 12 as illustrated in FIG. 1. Measurement tool 100 is equally well suited for use with any kind of subterranean drilling operation, either offshore or onshore. While measurement tool 100 is shown coupled with a drill string, it will also be understood that the invention is not limited to measurement while drilling (MWD) and logging while drilling (LWD) embodiments. Measurement tool 100, including radially offset standoff sensors 120A and 120B, may also be configured for use in wireline applications.

Figure 2A:
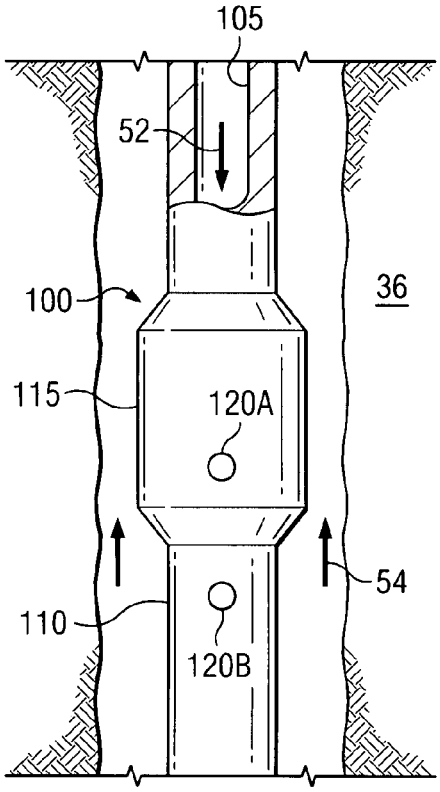
FIG. 2A depicts one exemplary embodiment of the downhole tool shown on FIG. 1.

Referring now to FIG. 2A, one exemplary embodiment of downhole measurement tool 100 according to the present invention is shown deployed in a subterranean borehole. In the exemplary embodiment shown, measurement tool 100 is configured as a measurement sub, including a substantially cylindrical tool collar 110 configured for coupling to a drill string (e.g., drill string 30 in FIG. 1) and therefore typically, but not necessarily, includes threaded pin and box end portions (not shown on FIG. 2A). Through pipe 105 provides a conduit for the flow of drilling fluid downhole, for example, to a drill bit assembly (e.g., drill bit 32 in FIG. 1). As is known to those of ordinary skill in the art, drilling fluid is typically pumped down through pipe 105 during drilling as shown at 52, and moves upwards through the borehole annulus as shown at 54. Measurement tool 100 includes first and second radially offset standoff sensors 120A and 120B. In the exemplary embodiment shown, sensor 120A is deployed in an enlarged housing 115 (or sleeve), while sensor 120B is deployed in the tool collar 110; however, the invention is not limited in this regard.

Figure 2B:
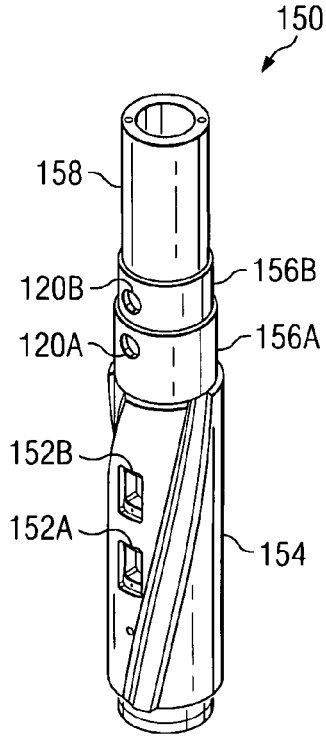
FIG. 2B depicts one exemplary embodiment of a logging while drilling tool in accordance with the present invention.

FIG. 2B depicts a portion of another exemplary embodiment of the present invention in which a logging while drilling (LWD) density-neutron-standoff-caliper tool 150 includes first and second radially offset standoff sensors 120A and 120B. LWD tool 150 also includes first and second nuclear (gamma ray) density sensors 152A and 152B located on a stabilizer section 154 of the tool collar 158 (although the invention is not limited in this regard). The first and second standoff sensors 120A and 120B are deployed on corresponding first and second radially offset step-down sections (sleeves) 156A and 156B between stabilizer 154 and tool collar 158. Deployment of the standoff sensors 120A and 120B on the step-down sections 156A and 156B tends to advantageously provide a recess (inward from the stabilizer 154) for protecting the sensors 120A and 120B (e.g., from impacts with the borehole wall). Such deployment also tends to allow better drilling fluid flow and cutting removal upward through the wellbore annulus during drilling.

With continued reference to FIGS. 2A and 2B, it will be appreciated that standoff sensors 120A and 120B may include substantially any known ultrasonic standoff sensors suitable for use in downhole tools. For example, sensors 120A and 120B may include conventional piezo-ceramic and/or piezo-composite transducer elements. Suitable piezo-composite transducers are disclosed, for example, in commonly assigned U.S. Pat. No. 7,036,363. Transducer elements 120A and 120B may also be configured to operate in pulse-echo mode, in which a single element is used as both the transmitter and receiver, or in a pitch-catch mode in which one element is used as a transmitter and a separate element is used as the receiver. Typically, a pulse-echo transducer may generate ring-down noise (the transducer once excited reverberates for a duration of time before an echo can be received and analyzed), which, unless properly damped or delayed, can overlap and interfere with the received waveform. Pitch-catch transducers tend to eliminate ring-down noise, and are generally preferred, provided that the cross-talk noise between the transmitter and receiver is sufficiently isolated and damped.

Although not shown on FIGS. 2A and 2B, it will be appreciated that downhole tools in accordance with this invention typically include an electronic controller. Such a controller typically includes conventional electrical drive voltage electronics (e.g., a high voltage power supply) for applying waveforms to standoff sensors 120A and 120B. The controller typically also includes receiving electronics, such as a variable gain amplifier for amplifying the relatively weak return signal (as compared to the transmitted signal). The receiving electronics may also include various filters (e.g., pass band filters), rectifiers, multiplexers, and other circuit components for processing the return signal.

A suitable controller typically further includes a digital programmable processor such as a microprocessor or a microcontroller and processor-readable or computer-readable programming code embodying logic, including instructions for controlling the function of the tool. Substantially any suitable digital processor (or processors) may be utilized, for example, including an ADSP-2191M microprocessor, available from Analog Devices, Inc. The controller may be disposed, for example, to execute drilling fluid evaluation methods 200 and/or 250 described in more detail below with respect to FIGS. 4A and 4B. A suitable controller may therefore include instructions for determining arrival times and amplitudes of various received waveform components and for solving the algorithms set forth in Equations 1 and 7 through 9.

A suitable controller may also optionally include other controllable components, such as sensors, data storage devices, power supplies, timers, and the like. The controller may also be disposed to be in electronic communication with various sensors and/or probes for monitoring physical parameters of the borehole, such as a gamma ray sensor, a depth detection sensor, or an accelerometer, gyro or magnetometer to detect azimuth and inclination. The controller may also optionally communicate with other instruments in the drill string, such as telemetry systems that communicate with the surface. The controller may further optionally include volatile or non-volatile memory or a data storage device. The artisan of ordinary skill will readily recognize that the controller may be disposed elsewhere in the drill string (e.g., in another LWD tool or sub).

Figure 3:
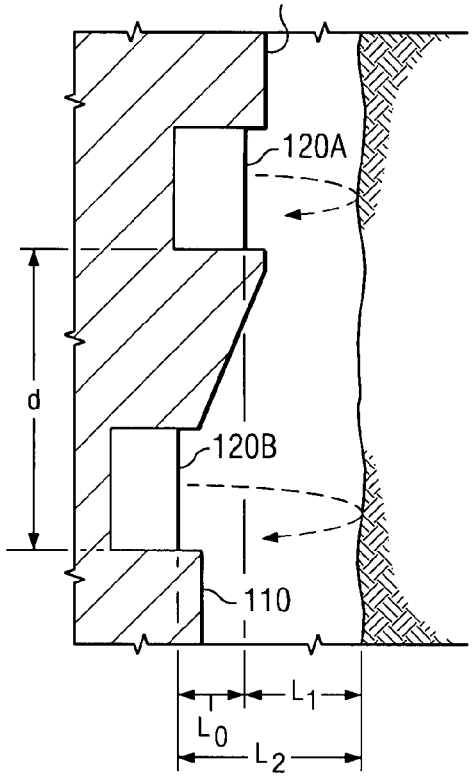
FIG. 3 depicts, in cross-section, a portion of the embodiment shown on FIG. 2A.

With reference now to FIG. 3, a cross section of a portion of the embodiment shown on FIG. 2A is illustrated. As stated above, sensors 120A and 120B are radially and axially offset in tool body 110. While the invention is not limited in this regard, sensors 120A and 120B are preferably radially offset by a distance $L_0$ in the range from about 0.25 to about 0.50 inches. At radial offset distances less than about 0.25 inch, measurement accuracy tends to decrease owing to the decreasing time delay between corresponding wellbore reflection echoes. Distances greater than about 0.50 inches cause more signal attenuation loss and tend to be difficult to accommodate on a conventional downhole LWD tool (primarily due to mechanical constraints). Sensors 120A and 120 are also typically axially spaced as close as structurally feasible on the tool body. In certain advantageous embodiments sensors 120A and 120B are axially spaced a distance d of less than or equal to about 1 foot.

With continued reference to FIG. 3, the offset distance between the two sensors 120A and 120B may be represented mathematically, for example, as $L_0=L_2-L_1+\Delta\epsilon$ where $L_1$ represents the standoff distance of sensor 120A, $L_2$ represents the standoff distance of sensor 120B, and $\Delta\epsilon$ represents a variable standoff deviation resulting, for example, from roughness differences in the borehole wall adjacent the sensors 120A and 120B. In many drilling applications (and formation types) in certain wellbore sections the borehole wall is sufficiently smooth such that the standoff deviation is much less than the offset distance between the two standoff sensors (i.e., $\Delta\epsilon \ll L_0$). Thus the offset distance between the sensors 120A and 120B is approximately equal to the difference between the standoff distances at the first and second sensors 120A and 120B when the tool 100 is deployed in a borehole (i.e., $L_0=L_2-L_1$). Borehole roughness effects may be accounted, for example, as described in more detail below.

Figure 4A:
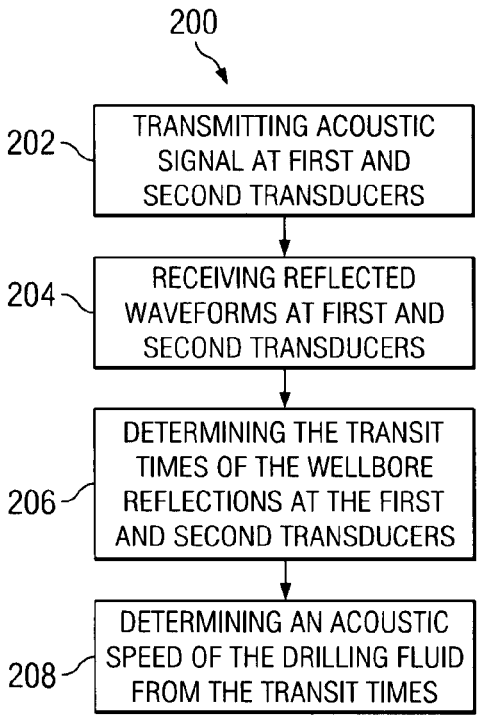
FIG. 4A depicts a flowchart of one exemplary method embodiment in accordance with this invention for determining a drilling fluid acoustic velocity.
Figure 4B:
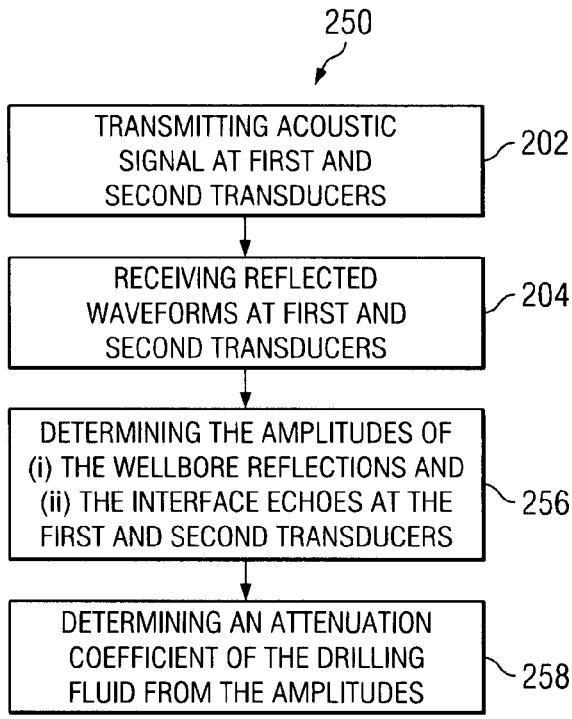
FIG. 4B depicts a flowchart of one exemplary method embodiment in accordance with this invention for determining a drilling fluid attenuation coefficient.

Turning now to FIGS. 4A and 4B, exemplary method embodiments 200 and 250 in accordance with the present invention are shown in flowchart form. Methods 200 and 250 advantageously tend to enable certain drilling fluid acoustic properties to be determined in real time during drilling. Method 200 is a method for determining the drilling fluid acoustic speed (the speed of sound in the drilling fluid), while method 250 is a method for determining an acoustic attenuation coefficient of the drilling fluid. It will be appreciated that methods 200 and 250 are typically, although not necessarily, employed substantially simultaneously to determine both the acoustic speed and the attenuation coefficient of the drilling fluid. It will also be appreciated that methods 200 and 250 may be employed in substantially real time during drilling, during an interruption in drilling (e.g., while a new joint is being coupled to the drill string), or during subsequent wireline operations. The invention is not limited in this regard.

With reference now to FIG. 4A, method 200 includes transmitting the first and second acoustic signals (e.g., ultrasonic pressure pulses) at the corresponding first and second standoff sensors 120A and 120B at step 202. The first and second standoff sensors 120A and 120B are may be advantageously fired substantially simultaneously to eliminate drill string rotation effects. However, it will be appreciated that it is typically less complex to fire the transducers sequentially, as opposed to simultaneously, to save power and minimize acoustic interference in the borehole. Thus, the standoff sensors 120A and 120B may also be fired sequentially provided that the time interval between firings is sufficiently short (e.g., less than about 10 milliseconds for drill string rotation rates on the order of 100 rpm). For wireline tools (or measurements made in sliding mode) much longer time intervals between firings can be accommodated.

With continued reference to FIG. 4A, first and second reflected waveforms are then received at the corresponding first and second standoff sensors 120A and 120B at step 204. As stated above, the reflected waveforms may be received by the same transducer elements from which they were transmitted (pulse-echo mode) or at separate transducer elements (pitch-catch mode). The invention is not limited in this regard. At step 206, the transit times are determined for the first and second wellbore reflections received at the corresponding first and second standoff sensors 120A and 120B. The acoustic speed of the drilling fluid may then be determined at 208 from the transit times (e.g., from a difference in the transit times) determined at 206.

With reference to FIG. 4B, method 250 is similar to method 200 in that it includes steps 202 and 204, which include transmitting first and second acoustic signals and receiving first and second reflected waveforms at the corresponding first and second standoff sensors 120A and 120B. At step 256, the amplitudes of both the (i) wellbore reflection echoes and the interface echoes are determined for each of the first and second reflected waveforms received in step 204. At step 258 and attenuation coefficient of the drilling fluid may be determined from the amplitudes (e.g., from a ratio of the amplitudes) determined in step 256.

Figure 5:
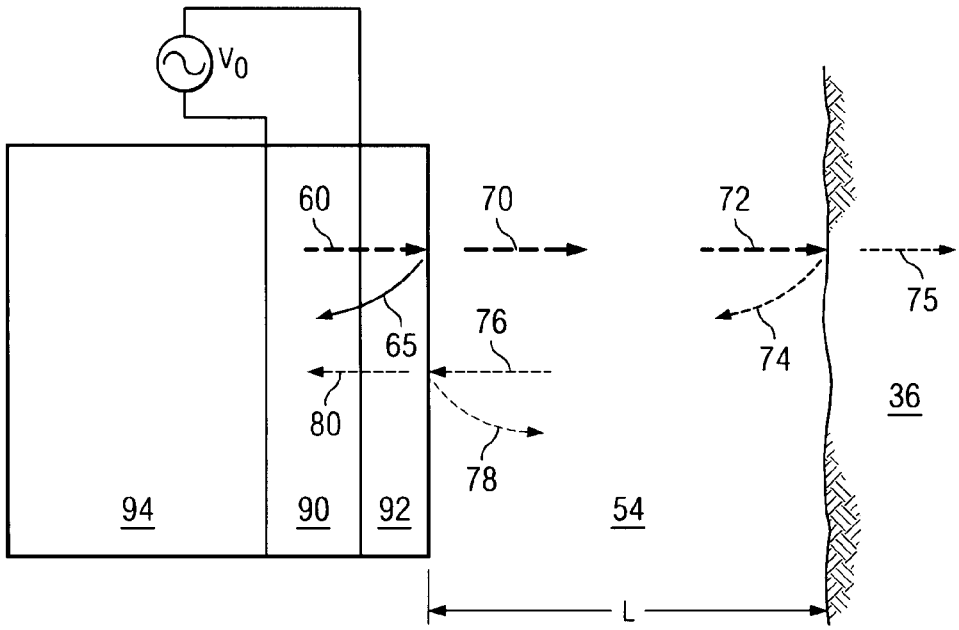
FIG. 5 is a schematic depiction of ultrasonic wave transmission, reflection, and reception in a borehole.

With reference now to FIG. 5, and for the purpose of describing exemplary embodiments in accordance with the present invention in greater technical detail, acoustic wave transmission and reflection in a borehole is schematically depicted. A typical standoff sensor (e.g., sensors 120A and 120B) includes a piezo-electric transducer element 90 (such as a piezo-ceramic or piezo-composite element) deployed between one or more front layers 92 (which is typically configured to provide impedance matching and/or transducer protection) and a backing layer 94. Such sensor construction is conventional in the art. In the exemplary embodiment shown, transducer element 90 includes a conventional pulse-echo transducer. This is for clarity of exposition and ease of illustration only. Those of ordinary skill in the art will readily recognize that pitch-catch transducer configurations may be equivalently utilized. When excited by an input voltage, $V_0$, transducer element 90 generates a pressure wave 60 inside the transducer. The pressure wave 60 propagates outward through front layer 92 towards the annular column of drilling fluid 54. A portion 65 of the wave is reflected back towards the transducer 90 by the interface between the front layer 92 and the drilling fluid 54. As is known to those of ordinary skill in the art, the transmission and reflection coefficient of the reflected wave 65 depends on the acoustic impedance, $Z_t$, of front layer 92 and on the acoustic impedance, $Z_f$, of the drilling fluid 54.

The remainder of pressure wave 60 propagates through the interface and is denoted by pressure wave 70. As wave 70 propagates in the drilling fluid 54, ultrasonic energy is lost due to attenuation of wave 70 in the drilling fluid. Thus, an attenuated wave 72 is incident on the interface between the drilling fluid 54 and the formation 36. The reflection coefficient at the fluid-solid boundary is known to be a complicated function of several variables, for example, including the incident angle, the impedance and the speed of sound in the drilling fluid 54, and the longitudinal wave acoustic velocity and impedance of the formation 36. In the case of oblique incidence, where mode conversion may occur, the reflection coefficients may also be a function of the shear wave acoustic velocity and the complex than normal specific impedance of the formation 36 (Wu, et al., J. Acoustic Society of America 87(6), 2349-2358, 1990 and Kinsler, et al., Fundamentals of Acoustics, $4^{th}$ Edition, Wiley, 1999). Notwithstanding, a portion of wave 72 is transmitted 75 into the formation 36. The remainder is reflected 74 back towards transducer element 90 through the attenuating drilling fluid 54. Upon reaching the transducer element 90, the ultrasonic wave 76 is again split, with a portion 78 reflecting back into the drilling fluid and the remainder being received by the transducer 90 as a wellbore reflection echo 80.

Figure 6:
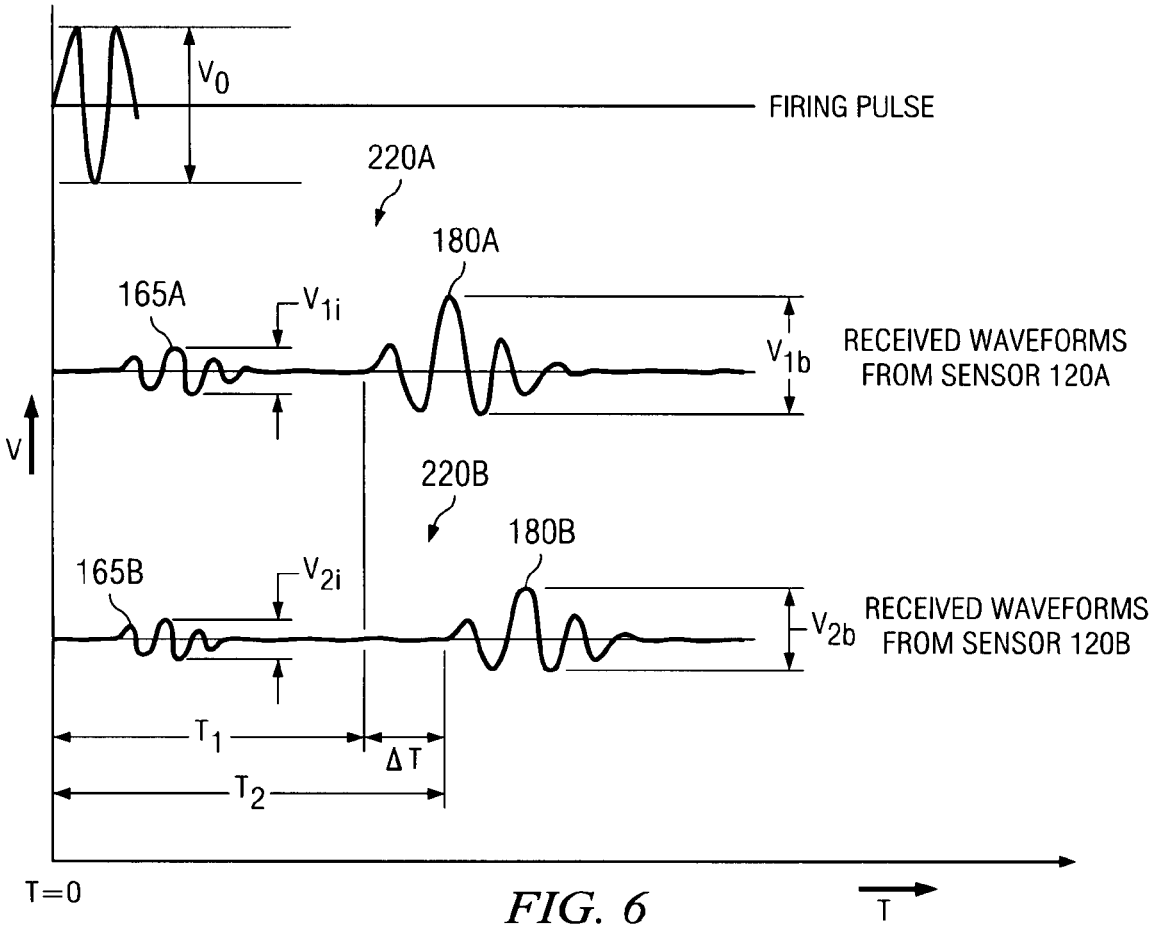
FIG. 6 is a schematic depiction of first and second ultrasonic waveforms received at corresponding first and second standoff sensors.

As stated above with respect to FIGS. 4A and 4B, method embodiments 200 and 250 include receiving first and second reflected waveforms at the corresponding first and second sensors 120A and 120B. With reference now to FIG. 6, exemplary embodiments of the first and second waveforms 220A and 220B received by the corresponding first and second standoff sensors 120A and 120B are schematically depicted. As stated above with respect to FIG. 5, the drive voltage amplitude for each transducer element 90 is $V_0$. In the exemplary embodiment shown, each waveform 220A and 220B includes an front layer-drilling fluid interface echo 165A and 165B and a subsequent (later) wellbore reflection echo 180A and 180B. As depicted, the amplitudes, $V_{1i}$ and $V_{2i}$, of the interface echoes 165A and 165B are less than the amplitudes, $V_{1b}$ and $V_{2b}$, of the wellbore reflection echoes 180A and 180B. While the relative amplitudes tend to be realistic for typical LWD applications, it will be understood that the invention is not limited in this regard.

With reference again to FIGS. 4A and 4B, the transit times, $T_1$ and $T_2$, of the first and second wellbore reflection echoes 180A and 180B may be determined at step 206 via either analog or digital techniques. Digital-based signal processing techniques are generally preferred and typically include digitizing, smoothing, and filtering the received waveform using known techniques prior to determining the arrival times and peak amplitudes. Waveform detection methods, such as correlation of the digitized waveforms with a template waveform including representative formation echoes for various downhole conditions, may also be applied to determine $T_1$ and $T_2$ (FIG. 6) from which a time delay $\Delta T$ may be computed. Alternatively (and/or additionally) phase or semblance-based processing techniques (which are commonly utilized in processing sonic logging measurements) may also be advantageously utilized to directly determine the time delay $\Delta T$ without determining the individual arrival times $T_1$ and $T_2$.

After the received signals are digitized, smoothed, and filtered, amplitudes of various waveform components (e.g., the formation echoes 180A and 180B and the transducer fluid interface echoes 165A and 165B) may be determined at 256. For example, waveform attribute processing techniques such as the Hilbert transform (which is commonly utilized in seismic and sonic logging waveform processing), may be used to acquire a waveform envelope and time-energy distributions of the waveform from which the amplitudes of the various waveform components may be directly determined.

With reference now to FIGS. 4A and 6, a speed of sound in the drilling fluid may be determined at 208 from the corresponding transit times $T_1$ and $T_2$ of the first and second wellbore reflection echoes 180A and 180B. In particular, the speed of sound in the drilling fluid tends to be inversely proportional to the time delay (difference) $\Delta T$ between the first and second transit times $T_1$ and $T_2$. The speed of sound in the drilling fluid may be expressed mathematically, for example, as follows:

$$c_f = \frac{2L_2 - 2L_1}{T_2 - T_1} \approx \frac{2L_0}{\Delta T} \quad \text{Equation 1}$$

where $c_f$ represents the speed of sound in the drilling fluid, $L_1$ and $L_2$ represent standoff distances at the first and second standoff sensors 120A and 120B (as described above with respect to FIG. 3), $L_0$ represents the radial offset distance between the sensors, $T_1$ and $T_2$ represent transit times of the first and second wellbore reflection echoes 180A and 180B, and $\Delta T$ represents the time delay between the wellbore reflection echoes.

With reference now to FIGS. 4B and 6, an attenuation coefficient of the acoustic energy in the drilling fluid may be determined at 258 from the amplitudes $V_{1i}$ and $V_{2i}$, of the interface echoes 165A and 165B and the amplitudes, $V_{1b}$ and $V_{2b}$, of the wellbore reflection echoes 180A and 180B. In general the attenuation coefficient tends to increase as the ratio $V_{1b}/V_{2b}$ increases. The amplitudes $V_{1i}$ and $V_{2i}$ of the interface echoes 165A and 165B may be expressed mathematically, for example, as follows:

$$V_{1i}=K_1V_0R_{t\text{-}f} \quad \text{Equation 2}$$

$$V_{2i}=K_2V_0R_{t\text{-}f} \quad \text{Equation 3}$$

where $K_1$ and $K_2$ represent transmit-receive factors for the corresponding first and second standoff sensors 120A and 120B, $V_0$ represents the drive voltage, and $R_{t\text{-}f}$ represents a reflection coefficient at the front layer-drilling fluid interface. As is known to those of ordinary skill in the art, $K_1$ and $K_2$ represent a characteristic parameter of a standoff sensor that sometimes varies with downhole conditions. As is also known to those of skill in the art, $R_{t\text{-}f}$ may be expressed mathematically, for example, as follows:

$$R_{t-f} = \frac{Z_f - Z_t}{Z_f + Z_t} \quad \text{Equation 4}$$

where $Z_t$ and $Z_f$ represent acoustic impedances of the front layer (e.g., layer 92 on FIG. 5) and the drilling fluid, respectively.

With continued reference to FIGS. 4B and 6, the amplitudes $V_{1b}$ and $V_{2b}$ of the wellbore reflection echoes 180A and 180B are generally mathematically more complicated than amplitudes $V_{1i}$ and $V_{2i}$ of the interface echo's 165A and 165B. As stated above, the amplitudes of the wellbore reflection echoes are typically a complicated function of several variables. For the general case, in which the ultrasonic energy is obliquely incident on the borehole wall, $V_{1b}$ and $V_{2b}$ may be expressed mathematically, for example, as follows:

$$V_{1b}=K_1V_0e^{-2L_1\alpha}\cdot F(\phi,Z_t,Z_f,Z_b,c_t,c_f,c_{bp},c_{bs},X_n) \quad \text{Equation 5}$$

$$V_{2b}=K_2V_0e^{-2L_2\alpha}\cdot F(\phi,Z_t,Z_f,Z_b,C_t,c_f,c_{bp},c_{bs},X_n) \quad \text{Equation 6}$$

where $K_1$, $K_2$, $V_0$, $L_1$, and $L_2$ are as defined above, $\alpha$ represents the attenuation coefficient of the drilling fluid, and $F(\cdot)$ represents a mathematical function of the various parameters listed. The other parameters listed include the angle of incidence $\phi$, the acoustic impedance $Z_t$ and wave velocity $c_t$ of the front layer 92 (FIG. 5), the acoustic impedance $Z_f$ and longitudinal velocity $c_f$ of the drilling fluid, the longitudinal impedance $Z_b$ and bulk velocity $c_{bp}$ of the formation, the shear velocity $c_{bs}$ of the formation, and the reactance $X_n$ of the complex formation normal impedance.

The attenuation coefficient of the drilling fluid may be obtained, for example, by dividing Equation 5 with Equation 6, canceling out the mathematical function $F(\cdot)$, and solving for $\alpha$. The attenuation coefficient $\alpha$ may thus be expressed mathematically, for example, as follows:

$$\alpha = \frac{1}{2(L_2 - L_1)}\left(\ln\left(\frac{V_{1b}}{V_{2b}}\right) - \ln\left(\frac{K_1}{K_2}\right)\right) = \frac{1}{2(L_2 - L_1)}\ln\left(\frac{V_{1b}K_2}{V_{2b}K_1}\right) \quad \text{Equation 7}$$

The ratio of the parameters $K_1$ and $K_2$ may be pre-calibrated prior to deployments of the downhole tool in a borehole. For example, the parameters $K_1$ and $K_2$ may be determined from reflection echoes from a known target at a fixed standoff for each of the sensors 120A and 120B. Alternatively, the ratio $K_1/K_2$ (in Equation 7) may be determined in substantially real time during acquisition of the standoff measurements from the amplitudes of the interface echoes 165A and 165B. It will be appreciated from Equations 3 and 4, that the ratio of the amplitudes $V_{1i}/V_{2i}$ equals the ratio $K_1/K_2$. Accordingly, Equation 7 may be alternatively expressed, for example, as follows:

$$\alpha = \frac{1}{2(L_2 - L_1)}\left(\ln\left(\frac{V_{1b}}{V_{2b}}\right) - \ln\left(\frac{V_{1i}}{V_{2i}}\right)\right) = \frac{1}{2(L_2 - L_1)}\ln\left(\frac{V_{1b}V_{2i}}{V_{2b}V_{1i}}\right) \quad \text{Equation 8}$$

Moreover, since the offset distance between the sensors 120A and 120B is approximately equal to the difference between the standoff distances at the first and second sensors 120A and 120B (i.e., $L_0=L_2-L_1$), Equation 8 may be expressed equivalently, for example, as follows for locally smooth borehole conditions:

$$\alpha = \frac{1}{2L_0}\left(\ln\left(\frac{V_{1b}}{V_{2b}}\right) - \ln\left(\frac{V_{1i}}{V_{2i}}\right)\right) = \frac{1}{2L_0}\ln\left(\frac{V_{1b}V_{2i}}{V_{2b}V_{1i}}\right) \quad \text{Equation 9}$$

With reference to Equations 8 and 9, it will be appreciated that the attenuation coefficient of the borehole fluid may be determined directly from the amplitudes of the interface echoes and the wellbore reflection echoes. It will be appreciated that the numerous parameters (e.g., the parameters included in Equations 5 and 6 in $F(\cdot)$) that effect the amplitude of an individual wellbore reflection echo are all advantageously canceled out of Equations 8 and 9. Therefore, there is no need to estimate or determine values for any of those parameters in order to determine the attenuation coefficient of the drilling fluid.

As stated above, Equations 1 and 9 assume that the borehole wall is locally smooth adjacent sensors 120A and 120B (i.e., $\Delta\epsilon << L_0$ so that $L_0 = L_2 - L_1$). However, as known to those of ordinary skill in the art, there are certain drilling situations in which the borehole wall may not be sufficiently smooth for $\Delta\epsilon << L_0$ to be satisfied (for example operations in which there is washout of the borehole wall and/or fracturing of the formation). If unaccounted, borehole roughness may result in unacceptably high errors in the fluid acoustic velocity and/or attenuation measurements (due to the high standoff deviation $\Delta\epsilon$ between the two sensors 120A and 120B).

Figure 7:
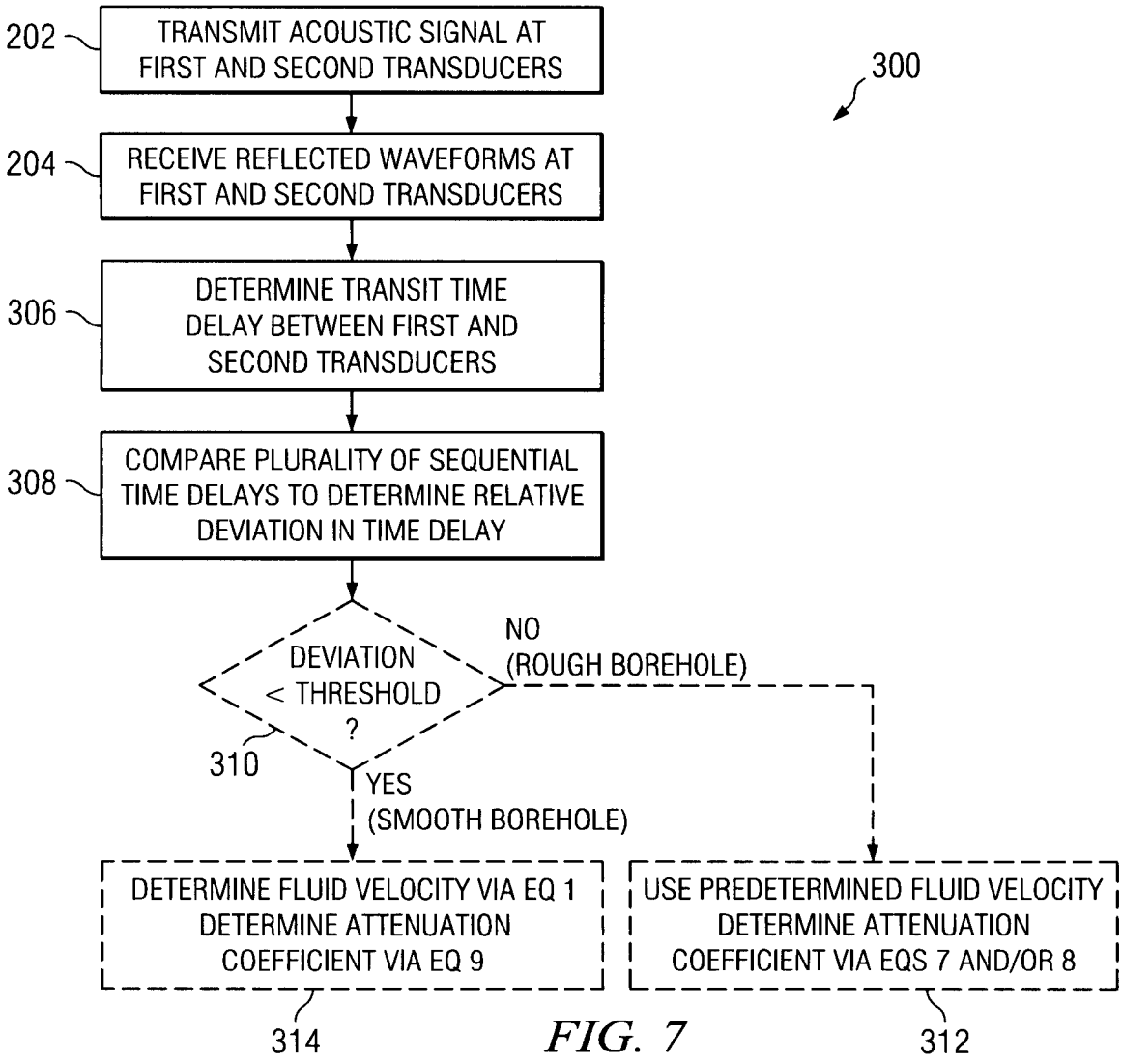
FIG. 7 depicts an alternative method embodiment in accordance with the present invention for determining and accommodating a local borehole roughness adjacent the standoff sensors.

With reference now to FIG. 7, borehole roughness may be locally determined 300, for example, via comparing transit time delays at a plurality of transducer firings (typically sequential firings). In the exemplary embodiment shown, borehole roughness may be quantified, for example, via: (i) determining at 306 the well-bore reflection transit time delay $\Delta T$ between sensors 120A and 120B (e.g., as described above with respect to step 206 in FIG. 4A) for a plurality of sequential transducer firings and (ii) comparing transit time delays at 308 to determine a relative deviation in $\Delta T$ during the plurality of transducer firings. It will be appreciated that the relative deviation in $\Delta T$ may be thought of as a quantitative measure of local borehole roughness (the roughness increasing monotonically with increasing deviation) and may be expressed mathematically, for example, as follows:

$$\delta = \left|\frac{\Delta T_i - \Delta T_{i-1}}{\Delta T_{i-1}}\right| \qquad \text{Equation 10}$$

where $\Delta T_i$ and $\Delta T_{i-1}$ represent sequential time delays between the wellbore reflection echoes and $\delta$ represents the deviation (i.e., the measure of borehole roughness).

As also shown at steps 310, 312, and 314 on FIG. 7, borehole roughness may be optionally accounted in determining the drilling fluid acoustic velocity and/or attenuation coefficient. For example, the relative deviation determined in step 308 may be compared with a predetermined threshold at 310. Depending on the drilling application and sensitivity requirements, the threshold deviation may be in the range, for example, from about 5 to about 10 percent (although the invention is not limited in this regard). If the relative deviation $\delta$ (e.g., as determined in Equation 10) is less than the threshold value (typically for several sequential firings), then the borehole wall may be considered to be locally smooth such that Equation 1 may be used to determine the drilling fluid acoustic velocity and Equation 9 may be utilized to determine the drilling fluid attenuation coefficient at 314. If the relative deviation $\delta$ is greater than the threshold value, then previously determined values of the drilling fluid acoustic velocity may utilized if required (e.g., in standoff determination or other LWD applications). Equations 7 and/or 8 may be utilized to determine the drilling fluid attenuation coefficient as shown at 312. It will be understood that the use of exemplary embodiments of method 300 to determine and account for local borehole roughness advantageously tends to minimize the effect of locally rough borehole conditions and therefore tends to improve reliability and accuracy of acoustic velocity and attenuation measurements.

It will be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

I claim:

1. A downhole measurement tool, comprising:

a substantially cylindrical tool body having a cylindrical axis;

first and second standoff sensors deployed on the tool body, the standoff sensors being radially offset from one another with respect to the longitudinal axis, each of the standoff sensors configured to (i) transmit an ultrasonic pressure pulse into a borehole and (ii) receive a reflected waveform; and a controller including instructions for determining a drilling fluid acoustic velocity according to the following equation:

$$c_f = \frac{2L_2 - 2L_1}{T_2 - T_1} \approx \frac{2L_0}{\Delta T}$$

wherein $c_f$ represents the drilling fluid acoustic velocity, $L_1$ and $L_2$ represent standoff distances at the first and second standoff sensors, $L_0$ represents a radial offset distance between the first and second standoff sensors, $T_1$ and $T_2$ represent arrival times of wellbore reflection components received at the first and second standoff sensors, and $\Delta T$ represents a difference between the arrival times.

2. The downhole measurement tool of claim 1, wherein the first and second standoff sensors are radially offset the distance in the range from about 0.25 to about 0.5 inches.

3. The downhole measurement tool of claim 1, wherein the first and second standoff sensors are longitudinally offset a distance of less than about 1 foot.

4. The downhole measurement tool of claim 1, wherein the first and second standoff sensors are deployed at substantially the same circumferential position on the tool body.

5. The downhole measurement tool of claim 1, wherein:

the tool body is configured for coupling with a drill string; and the measurement tool further comprises at least one logging while drilling sensor.

6. The downhole measurement tool of claim 5, wherein the logging while drilling sensor comprises at least one nuclear density sensor.

7. A method for determining an acoustic velocity of drilling fluid in a borehole, the method comprising:

(a) deploying a tool in the borehole, the tool including first and second transducers, the transducers being radially offset from one another with respect to a longitudinal axis of the tool;

(b) causing the first and second transducers to transmit corresponding first and second acoustic signals;

(c) causing the first and second transducers to receive corresponding first and second reflected signals from the acoustic signals transmitted in (b);

(d) determining a time delay between a predetermined wellbore reflection component of the corresponding first and second reflected signals received in (c); and (e) processing the time delay determined in (d) to determine the acoustic velocity of the drilling fluid according to the equation:

$$c_f = \frac{2L_2 - 2L_1}{T_2 - T_1} \approx \frac{2L_0}{\Delta T}$$

wherein $c_f$ represents the acoustic velocity of the drilling fluid, $L_1$ and $L_2$ represent standoff distances at the first and second transducers, $L_0$ represents a radial offset distance between the first and second transducers, $T_1$ and $T_2$ represent arrival times of the predetermined wellbore reflection components received at the first and second standoff sensors, and $\Delta T$ represents the time delay.

8. The method of claim 7, further comprising:

(f) determining first and second amplitudes of a wellbore reflection component of the corresponding first and second reflected signals received in (c); and (g) processing the first and second amplitudes determined in (f) to determine an attenuation coefficient of the drilling fluid.

9. The method of claim 7, wherein the transducers are further (i) axially offset from one another and (ii) circumferentially aligned with one another.

10. The method of claim 7, wherein the first and second transducers are deployed on a logging while drilling tool.

11. The method of claim 7, further comprising:

(f) comparing a plurality of the time delays determined in (d); and (g) determining the acoustic velocity in (e) only when a deviation of the time delays compared in (f) is less than a predetermined threshold.

12. A method for determining an attenuation coefficient of drilling fluid in a borehole, the method comprising:

(a) deploying a tool in the borehole, the tool including first and second transducers, the transducers being radially offset from one another with respect to a longitudinal axis of the tool;

(b) causing the first and second transducers to transmit corresponding first and second acoustic signals;

(c) causing the first and second transducers to receive corresponding first and second reflected signals the acoustic signals transmitted in (b);

(d) determining an amplitude of a first predetermined component of each of the corresponding first and second reflected signals received in (c); and (e) processing the amplitudes determined in (d) to determine the attenuation coefficient of the drilling fluid according to at least one equation selected from the group consisting of:

$$\alpha = \frac{1}{2(L_2 - L_1)}\left(\ln\left(\frac{V_{1b}}{V_{2b}}\right) - \ln\left(\frac{K_1}{K_2}\right)\right) = \frac{1}{2(L_2 - L_1)}\ln\left(\frac{V_{1b}K_2}{V_{2b}K_1}\right);$$

$$\alpha = \frac{1}{2(L_2 - L_1)}\left(\ln\left(\frac{V_{1b}}{V_{2b}}\right) - \ln\left(\frac{V_{1i}}{V_{2i}}\right)\right) = \frac{1}{2(L_2 - L_1)}\ln\left(\frac{V_{1b}V_{2i}}{V_{2b}V_{1i}}\right); \text{ and}$$

$$\alpha = \frac{1}{2L_0}\left(\ln\left(\frac{V_{1b}}{V_{2b}}\right) - \ln\left(\frac{V_{1i}}{V_{2i}}\right)\right) = \frac{1}{2L_0}\ln\left(\frac{V_{1b}V_{2i}}{V_{2b}V_{1i}}\right)$$

wherein $\alpha$ represents the attenuation coefficient of the drilling fluid, $L_1$ and $L_2$ represent standoff distances at the first and second transducers, $L_0$ represents a radial offset distance between the first and second transducers, $K_1$ and $K_2$ represent characteristic parameters of the corresponding first and second transducers. $V_{1i}$ and $V_{2i}$ represent amplitudes of interface reflection components received at the corresponding first and second transducers, and $V_{1b}$ and $V_{2b}$ represent amplitudes of wellbore reflection components received at the corresponding first and second standoff sensors.

13. The method of claim 12, wherein the transducers are further (i) axially offset from one another and (ii) circumferentially aligned with one another.

14. The method of claim 12, further comprising:

(f) determining a time delay between a predetermined wellbore reflection component of the corresponding first and second reflected signals received in (c); and (g) processing the time delay determined in (f) to determine an acoustic velocity of the drilling fluid.

15. The method of claim 12, wherein the first and second transducers are deployed on a logging while drilling tool.

16. A downhole measurement tool, comprising:

a substantially cylindrical tool body having a cylindrical axis;

first and second standoff sensors deployed on the tool body, the standoff sensors being radially offset from one another with respect to the longitudinal axis, each of the standoff sensors configured to (i) transmit an ultrasonic pressure pulse into a borehole and (ii) receive a reflected waveform; and a controller including instructions for determining a drilling fluid attenuation coefficient according to at least one equation selected from the group consisting of:

$$\alpha = \frac{1}{2(L_2 - L_1)}\left(\ln\left(\frac{V_{1b}}{V_{2b}}\right) - \ln\left(\frac{K_1}{K_2}\right)\right) = \frac{1}{2(L_2 - L_1)}\ln\left(\frac{V_{1b}K_2}{V_{2b}K_1}\right);$$

$$\alpha = \frac{1}{2(L_2 - L_1)}\left(\ln\left(\frac{V_{1b}}{V_{2b}}\right) - \ln\left(\frac{V_{1i}}{V_{2i}}\right)\right) = \frac{1}{2(L_2 - L_1)}\ln\left(\frac{V_{1b}V_{2i}}{V_{2b}V_{1i}}\right); \text{ and}$$

-continued $$\alpha = \frac{1}{2L_0}\left(\ln\left(\frac{V_{1b}}{V_{2b}}\right) - \ln\left(\frac{V_{1i}}{V_{2i}}\right)\right) = \frac{1}{2L_0}\ln\left(\frac{V_{1b}V_{2i}}{V_{2b}V_{1i}}\right)$$

wherein $\alpha$ represents the drilling fluid attenuation coefficient, $L_1$ and $L_2$ represent standoff distances at the first and second standoff sensors, $L_0$ represents a radial offset distance between the first and second standoff sensors, $K_1$ and $K_2$ represent characteristic parameters of the corresponding first and second standoff sensors, $V_{1i}$ and $V_{2i}$ represent amplitudes of interface reflection components received at the corresponding first and second standoff sensors, and $V_{1b}$ and $V_{2b}$ represent amplitudes of wellbore reflection components received at the corresponding first and second standoff sensors.

17. The downhole measurement tool of claim 16, wherein the first and second standoff sensors are radially offset the distance in the range from about 0.25 to about 0.5 inches.

18. The downhole measurement tool of claim 16, wherein the first and second standoff sensors are longitudinally offset a distance of less than about 1 foot.

19. The downhole measurement tool of claim 16, wherein the first and second standoff sensors are deployed at substantially the same circumferential position on the tool body.

20. The downhole measurement tool of claim 16, wherein:

the tool body is configured for coupling with a drill string; and the measurement tool further comprises at least one logging while drilling sensor.

21. The downhole measurement tool of claim 20, wherein the logging while drilling sensor comprises at least one nuclear density sensor.

* * * * *